US011406992B2

(12) United States Patent
Wang et al.

(10) Patent No.: US 11,406,992 B2
(45) Date of Patent: Aug. 9, 2022

(54) SHOWER HEAD FIXTURE

(71) Applicant: Xiamen Lota International Co., Ltd., Xiamen (CN)

(72) Inventors: Xuedong Wang, Xiamen (CN); Jiangcheng Zhang, Xiamen (CN); Yuzheng Wu, Xiamen (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 353 days.

(21) Appl. No.: 16/215,007

(22) Filed: Dec. 10, 2018

(65) Prior Publication Data

US 2019/0184409 A1 Jun. 20, 2019

Related U.S. Application Data

(63) Continuation-in-part of application No. 15/347,782, filed on Nov. 10, 2016, now Pat. No. 10,150,122.

(51) Int. Cl.

| | |
|---|---|
| ***B05B 1/16*** | (2006.01) |
| ***B05B 1/18*** | (2006.01) |
| ***B05B 1/30*** | (2006.01) |
| ***B05B 1/12*** | (2006.01) |
| ***E03C 1/04*** | (2006.01) |
| ***B05B 12/00*** | (2018.01) |
| *B05B 15/40* | (2018.01) |

(52) U.S. Cl.

CPC ..... *B05B 1/1609* (2013.01); *B05B 1/12* (2013.01); *B05B 1/1618* (2013.01); *B05B 1/1681* (2013.01); *B05B 1/185* (2013.01); *B05B 1/3013* (2013.01); *B05B 12/002* (2013.01); *E03C 1/04* (2013.01); *B05B 15/40* (2018.02)

(58) Field of Classification Search

CPC ..... B05B 1/1609; B05B 1/185; B05B 12/002; B05B 1/1681; B05B 1/12; B05B 1/1618; B05B 1/3013; B05B 15/40; E03C 1/084; E03C 1/04

USPC ..... 239/419.5, 428.5, 443–449, 525, 530, 239/583, 586, 590–590.5, 556–558, 239/533.13, 533.14, 602, DIG. 12

See application file for complete search history.

(56) References Cited

U.S. PATENT DOCUMENTS

| | | | | |
|---|---|---|---|---|
| 4,303,201 | A | 12/1981 | Elkins | |
| 5,201,468 | A | 4/1993 | Freier | |
| 5,577,664 | A * | 11/1996 | Heitzman | B05B 1/1636 239/602 |
| 6,382,531 | B1 | 5/2002 | Tracy | |
| 7,100,845 | B1 * | 9/2006 | Hsieh | B05B 1/1627 239/444 |
| 7,494,074 | B2 | 2/2009 | Benstead | |
| 7,792,479 | B2 | 7/2010 | Li | |
| D621,002 | S | 8/2010 | Yongyan | |

(Continued)

*Primary Examiner* — Steven J Ganey

(74) *Attorney, Agent, or Firm* — Barnes & Thornburg LLP

(57) ABSTRACT

A shower head assembly includes a main body, a face plate, and a switching device installed inside the main body for controlling an outflow of water from the face plate. The circumferential portion of the face plate is provided with a plurality of water outlet units. Each water outlet unit includes a plurality of jet orifices for producing a plurality of fine spouts. Since the diameter of each jet orifice is small, the water discharge force of the fine spouts is stronger. The water-saving effect is good. The shower head can be used for a low water pressure environment.

21 Claims, 9 Drawing Sheets

(56) References Cited

U.S. PATENT DOCUMENTS

| | | | | |
|---|---|---|---|---|
| D622,812 | S | 8/2010 | Yongyan | |
| D639,391 | S | 6/2011 | Yongyan | |
| 9,216,424 | B2 * | 12/2015 | Kennedy | B05B 1/1636 |
| 9,545,639 | B2 | 1/2017 | Meehan | |
| 9,649,645 | B2 | 5/2017 | Erickson | |
| 9,707,572 | B2 | 7/2017 | Erickson | |
| 9,815,069 | B2 * | 11/2017 | Hou | B05B 15/654 |
| 10,005,090 | B1 | 6/2018 | Wang et al. | |
| 2016/0136659 | A1 * | 5/2016 | Erickson | F16K 11/20 239/443 |
| 2018/0126393 | A1 | 5/2018 | Wang et al. | |
| 2019/0184409 | A1 | 6/2019 | Wang et al. | |
| 2019/0224694 | A1 | 7/2019 | Wang et al. | |

* cited by examiner

SHOWER HEAD FIXTURE

CROSS-REFERENCE TO RELATED APPLICATIONS

This application is a continuation in part of U.S. patent application Ser. No. 15/347,782, filed Nov. 10, 2016, issued as U.S. Pat. No. 10,150,122, the disclosure of which is incorporated in its entirety herein by reference.

TECHNICAL FIELD

The present invention relates to a bathroom shower fixture, and more particularly to a shower head structure with multiple units of grouped jet orifices that provide discharged water flow with improved feel.

BACKGROUND OF THE INVENTION

With the improvement of people's living standards, people pay more attention to the quality of life and also whether a product is environmentally-friendly and efficient so as to not be wasteful of resources. For taking a shower, people now pay attention to the feeling of the water flow that falls on them during the shower and the water-saving effect. Numerous existing shower heads provide discharged water flow that does not provide physical ease and relaxation, instead, the water flow sprays in an uneven pattern that wastes some water, and is not environmentally friendly.

Accordingly, the present invention is intended to solve this problem and other shortcomings that are common to conventional shower heads. A full discussion of the features and advantages of the present disclosure is deferred to the following detailed description, which proceeds with reference to the accompanying drawings.

SUMMARY OF THE INVENTION

The present invention provides a shower head assembly which can increase the force of the outflow of water or discharge water effectively. The discharged water flow is grouped or arranged to provide "bubble water flow" that feels soft and comfortable to the user or person taking a shower under the inventive shower head. The discharged water flow avoids random spray that conserves water and improves the water-saving effect of the shower head. The shower head of the present invention is also suitable for low water pressure environment.

The shower head assembly includes a main body and a face plate or panel that is provided with a plurality of water outlet units that are spaced from each other. The water outlet units each comprise a cluster of jet orifices that are spaced from each other by a predetermined distance. In one example, the predetermined distance between the jet orifices is more than 1 mm. To provide the fine, strong water discharge spray that avoids random, inefficient spray, the jet orifices have a very small diameter, such as 0.2 mm-0.7 mm. In another example, the jet orifices each have a diameter of 0.2 mm-0.5 mm. In another example, the jet orifices each have a diameter of 0.5 mm-0.7 mm. In one example, the jet orifices each have a diameter of 0.2 mm-0.3 mm. In one example, the jet orifices each have a diameter of 0.3 mm-0.5 mm.

According to another aspect of the invention, the shower head assembly further comprises a bubbler installed in an intermediate or middle portion of the face plate. The at least one water outlet units are disposed on a circumferential portion of the face plate around the bubbler such that the clusters of jet orifices are arranged circumferentially around the bubbler.

According to another aspect of the invention, the main body comprises a housing and a water diversion body. The housing and the water diversion body are separate structures to be assembled together to form a combined component of the shower head assembly. Alternatively, the housing is integrally formed with the water diversion body.

According to another aspect of the invention, the face panel or plate is directly formed to the main body. The face panel is made of a plastic material by injection molding.

In one example, the at least one water outlet unit is formed of rubber materials by molding and then the face panel is formed by over-molding the plastic materials onto the at least one water outlet unit. Alternatively, the face panel and the at least one water outlet unit are assembled together, wherein the at least one water outlet unit is formed as one or more pieces with rubber materials by molding. Also, the face plate is formed from plastic materials by molding.

According to another aspect of the invention, a switching device is installed to the main body for controlling an outflow of water from the face plate. The face panel of the present invention has a plurality of water outlet units, wherein each water outlet unit includes a plurality of jet orifices. The water discharged or flowing from the plurality of jet orifices forms a bunched or arranged spout of discharged water flow that includes a plurality of fine spouts that avoids random, inefficient spray. Since the diameter of the jet orifice is small, the force of the fine spouts is strong and the water-saving effect of the shower head is good. The shower head of the present invention can be used for low pressure water environments.

Other features and advantages of the shower head assembly will be apparent from the following specification taken in conjunction with the following drawings. Additional advantages and novel features will be set forth in part in the description which follows, and in part will become apparent to those skilled in the art upon examination of the following and the accompanying drawings or may be learned by production or operation of the examples.

DETAILED DESCRIPTION OF THE PREFERRED EMBODIMENTS

Figure 1:
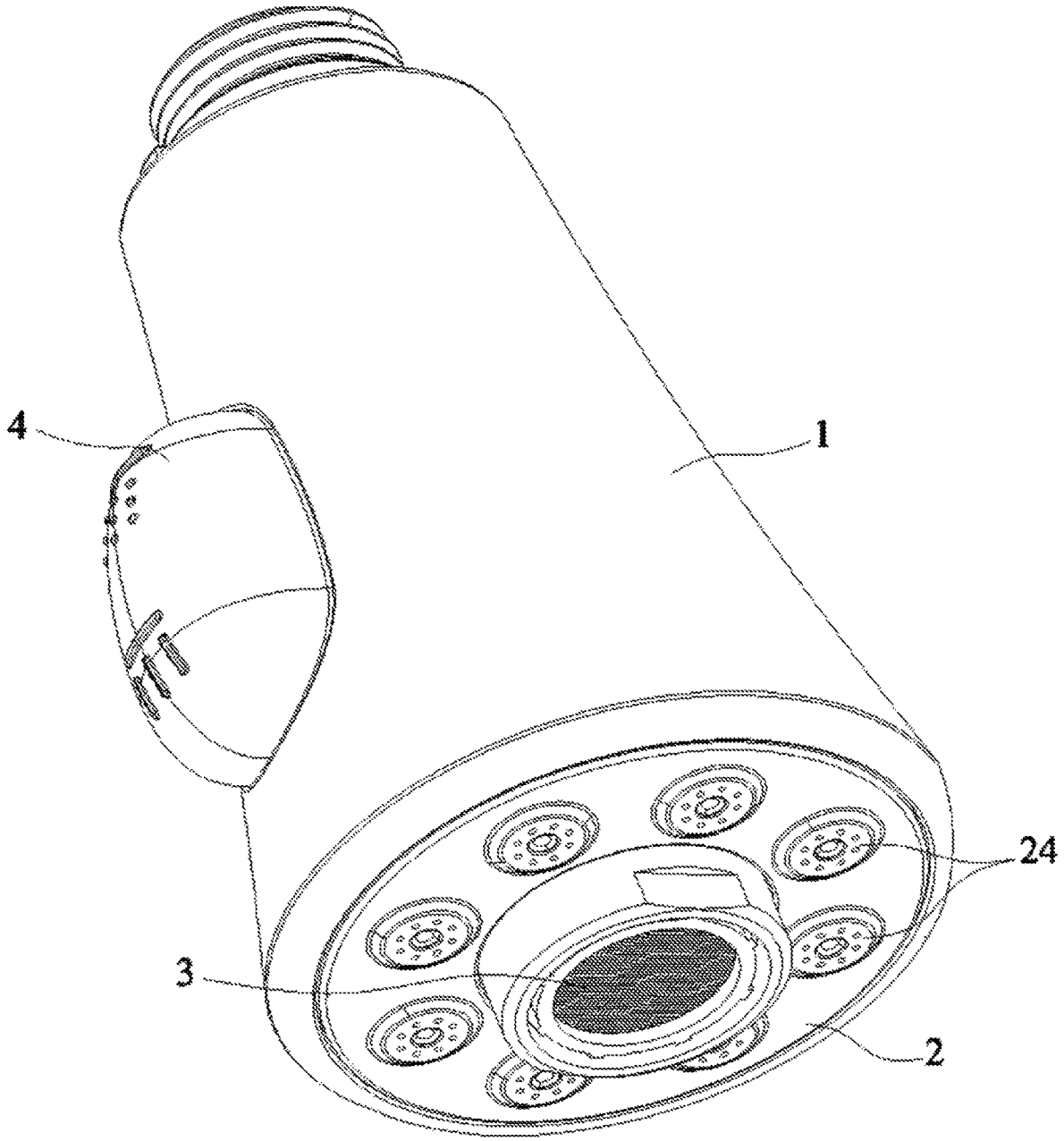
FIG. 1 is a perspective view of the shower head assembly of the present invention.

Embodiments of the present invention will now be described, by way of example only, with reference to the accompanying drawings.

As shown in FIG. 1 to FIG. 10, the present invention discloses a shower head assembly 10. The shower head assembly 10 comprises a main body 1, a face plate or panel 2, a bubbler component 3 installed in the intermediate portion of the face plate 2, and a switching device 4 installed to the main body 1 for controlling an outflow of discharged water from the face plate 2.

Figure 2:
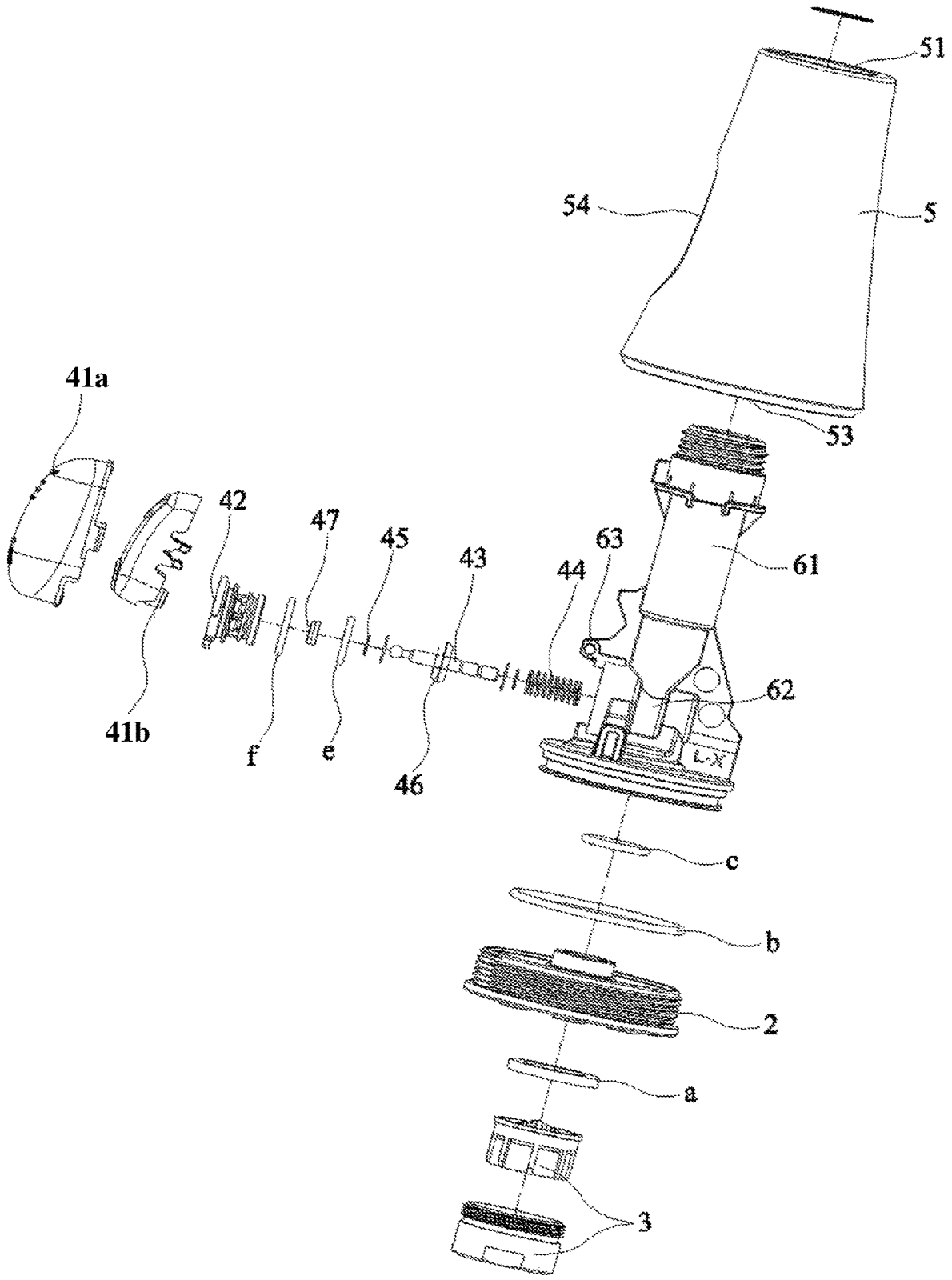
FIG. 2 is an exploded view of the shower head assembly.
Figure 3:
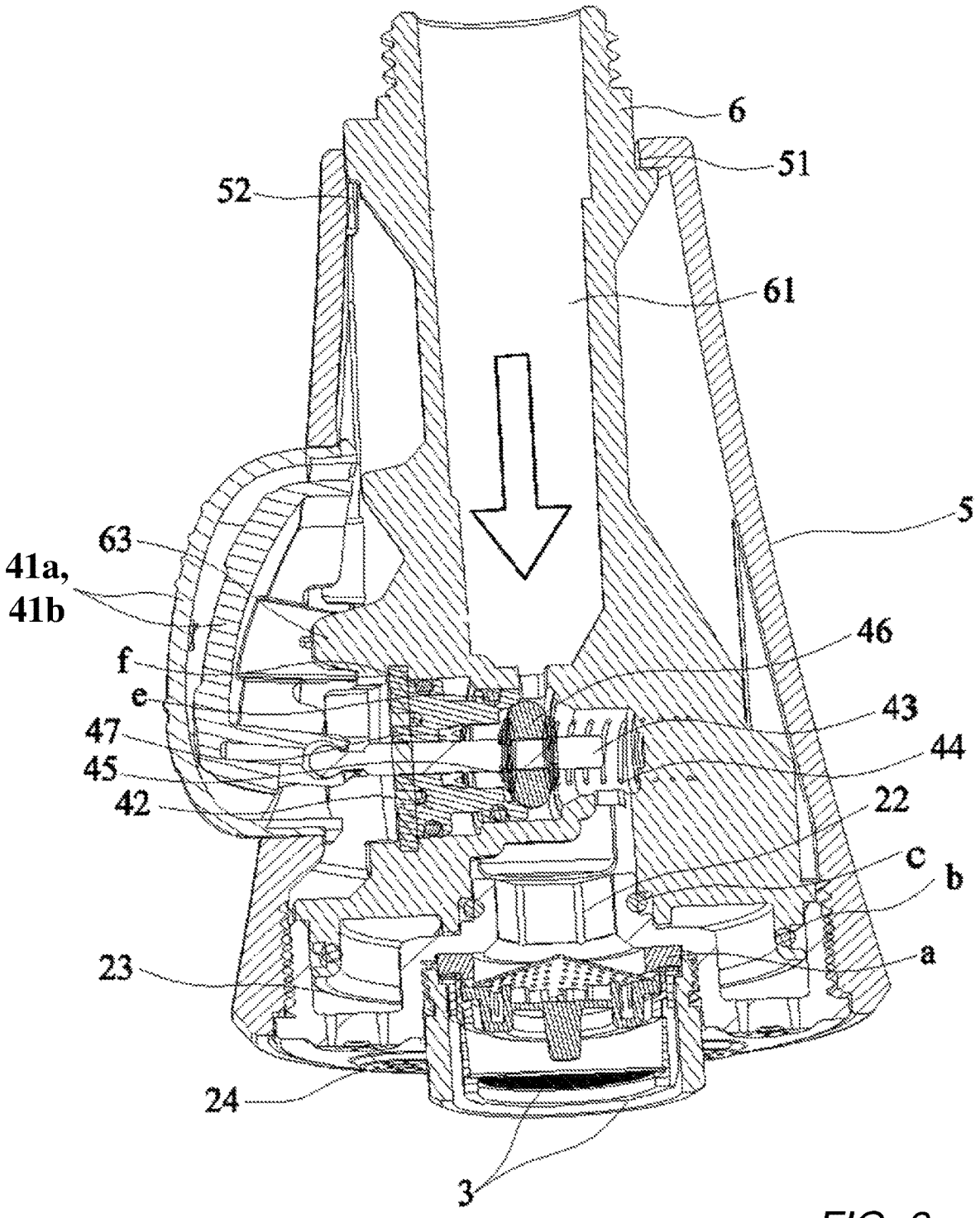
FIG. 3 is a sectional view of the shower head assembly taken along a longitudinal section plane.
Figure 4:
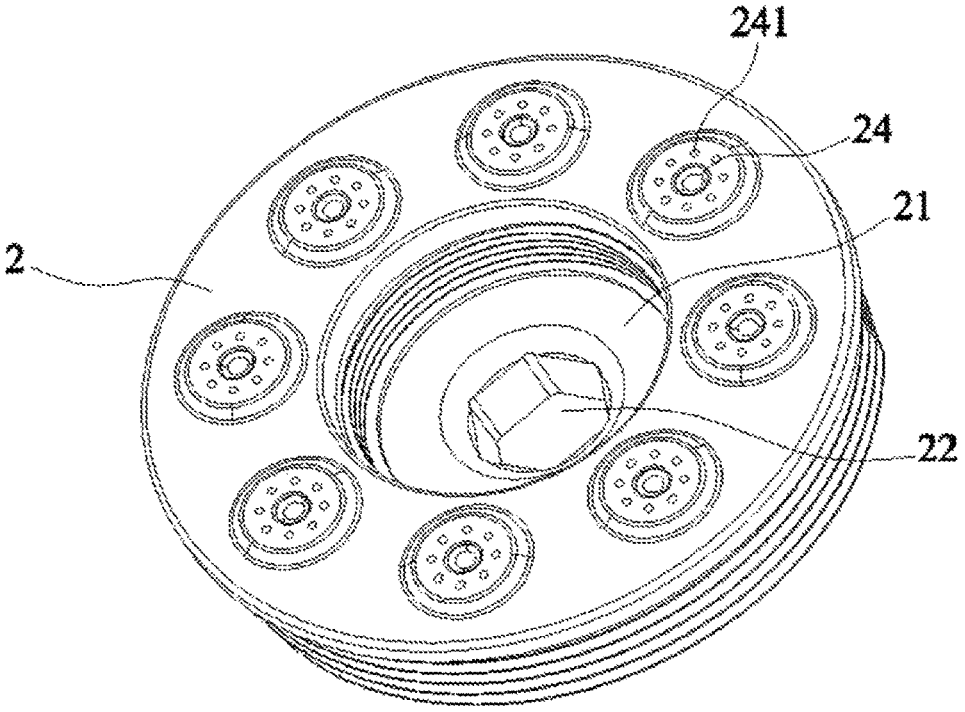
FIG. 4 is a front perspective view of the face panel of the shower head assembly.
Figure 5:
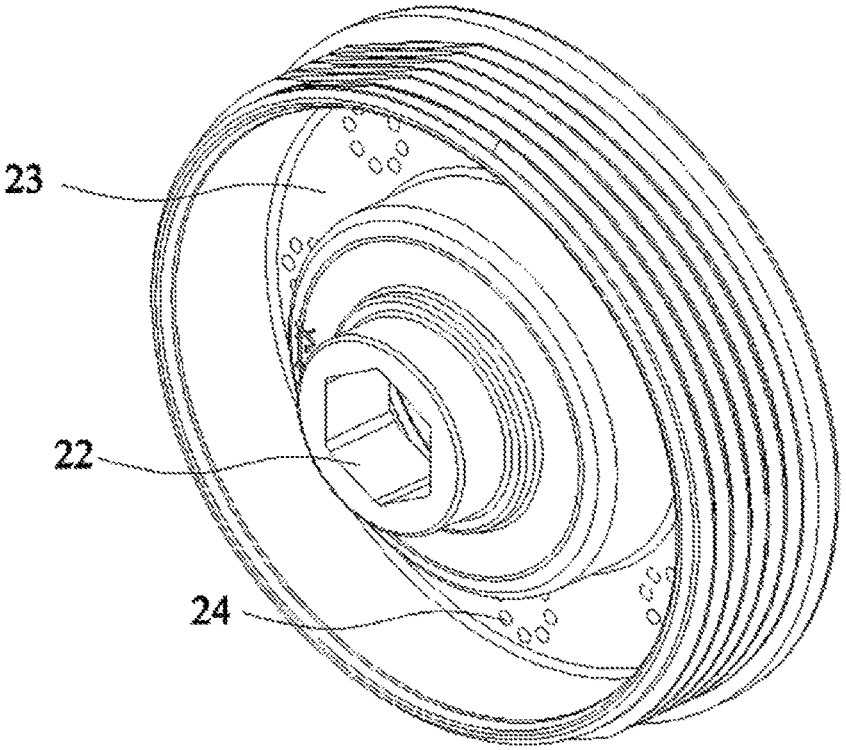
FIG. 5 is a rear perspective view of the face panel of the shower head assembly.
Figure 6:
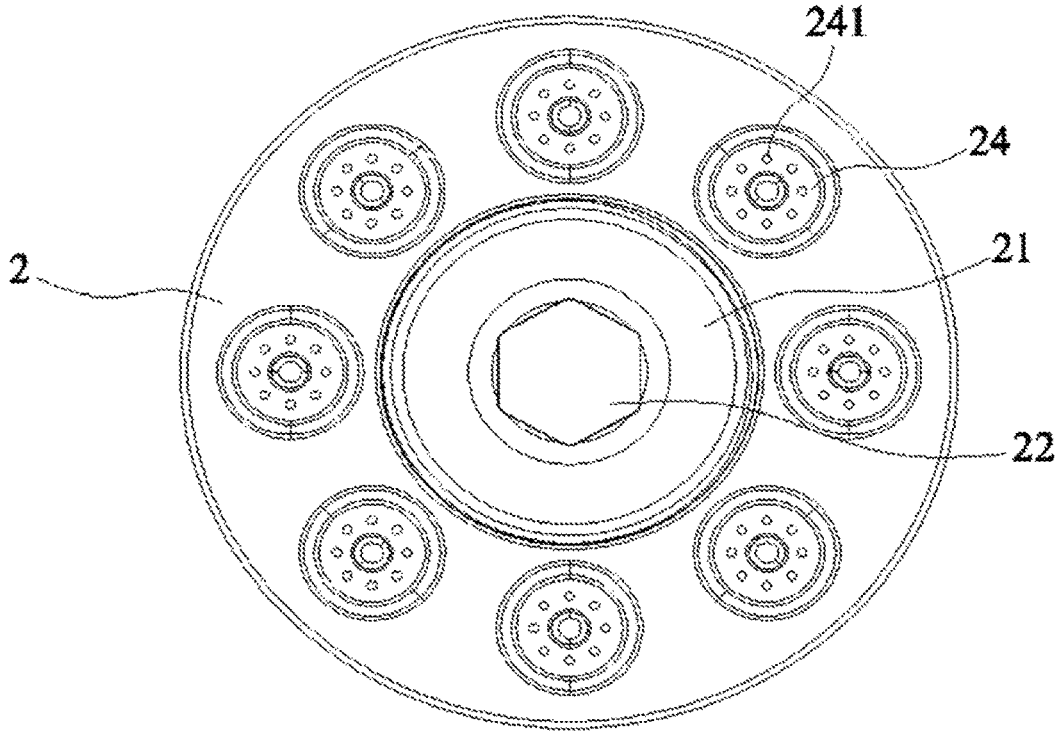
FIG. 6 is a front view of the face panel of the shower head assembly.
Figure 7:
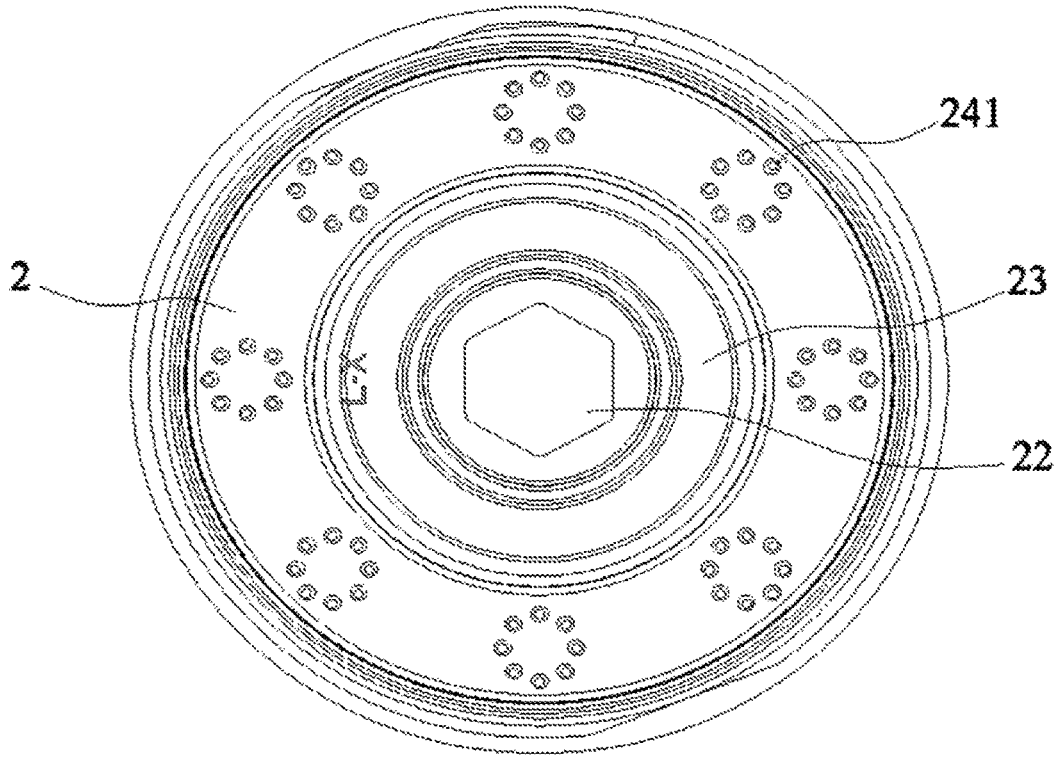
FIG. 7 is a rear view of the face panel of the shower head assembly.
Figure 8A:
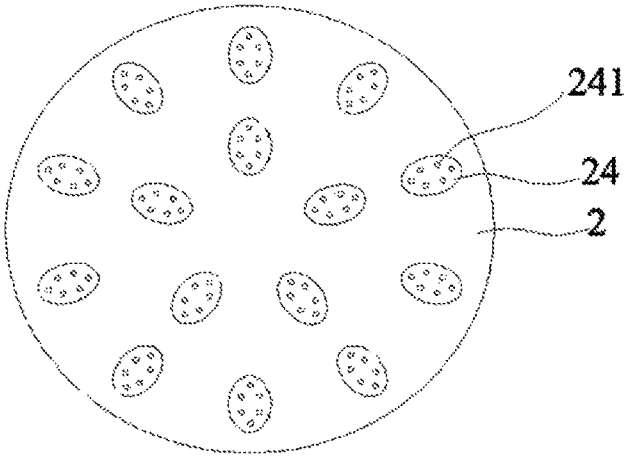
FIG. 8*a* through FIG. 8*e* are schematic views of different embodiments of the water outlet units of the shower head assembly.
Figure 8B:
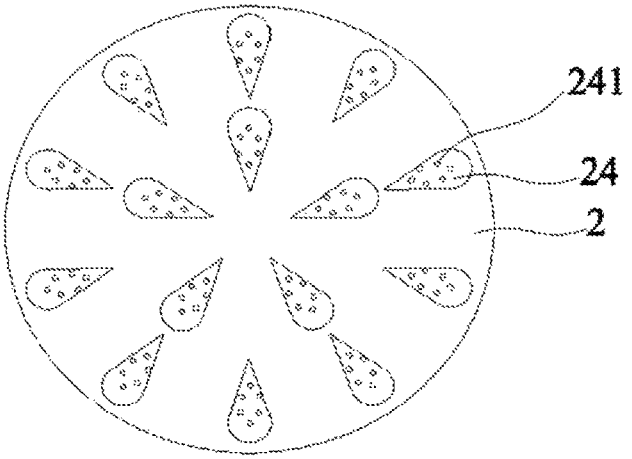
Figure 8C:
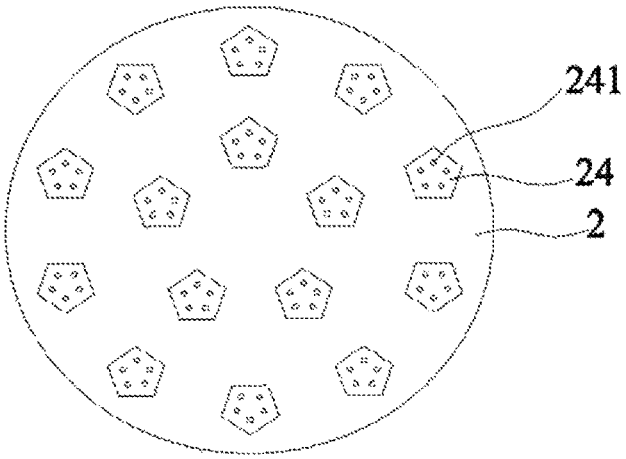
Figure 8D:
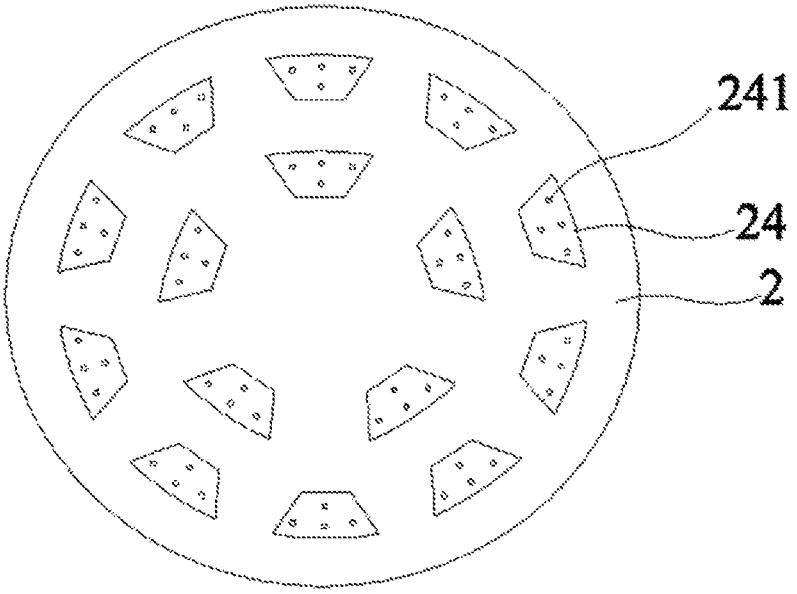
Figure 8E:
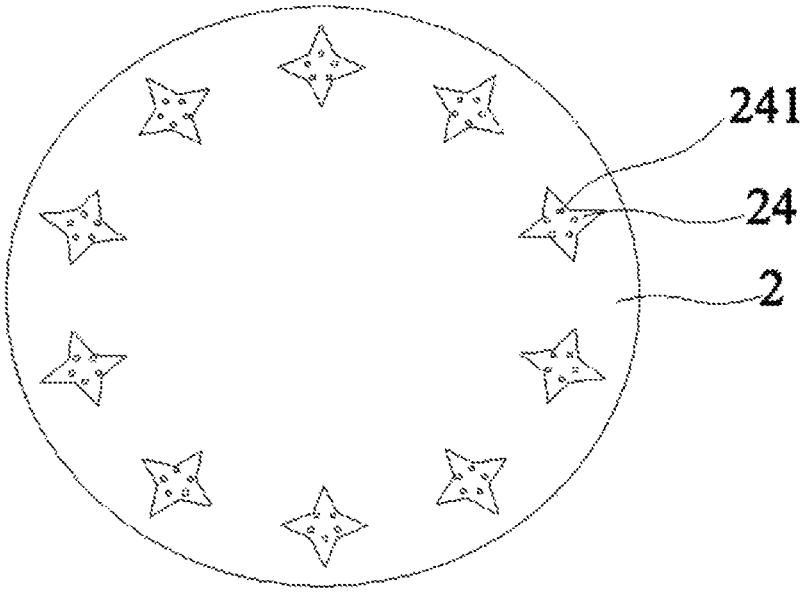

The center of the front of the face plate 2 has an installation trough 21 (seen in FIG. 4 for example) for installation of the bubbler 3 as shown in FIG. 3. The bubbler 3 is removably connected to the installation trough 21 by a fastener, such as a threaded fastener. In the illustrative embodiment, external threads on the bubbler 3 engage with internal threads of the installation trough 21 for connecting the bubbler 3 with the face plate 2 (see FIGS. 2-5). A sealing ring (a) is provided between the bubbler 3 and the installation trough 21. The center of the rear of the face plate 2 has a cylindrical first outlet chamber 22 communicating with the installation trough 21 as shown in FIGS. 4 and 5. The rear of the face plate 2 further has an annular second outlet chamber 23.

The circumferential portion of the front of the face plate 2 is provided with at least one water outlet unit 24. The water outlet unit 24 communicates with the second outlet chamber 23. The number of the water outlet units 24 is dependent on the required water discharge amount. The water outlet unit 24 includes at least two jet orifices 241. The water outlet unit 24 is shaped by the arrangement of the jet orifices 241. As shown in FIG. 8*a* to FIG. 8*e*, the water outlet unit 24 may be arranged on the face plate 2 in a circular, oval, pentagonal, triangular, crescent or other regular or irregular pattern. That is, the water outlet unit 24 is shaped by the jet orifices 241 arranged in a regular or irregular pattern on the face panel 2.

The diameter of each of the jet orifices 241 is in a range of 0.2 mm-0.7 mm. In this way, it can ensure that water outlet unit 24 provides the desired water discharge flow and pattern while still being suitable for use in different water pressure environments. That is, even if the water pressure environment is relatively low, the water outlet unit 24 still can provide "clusters" of thin water jets with a mist shape and a relatively strong force, without any unsuitable feeling of the water flow for the person taking a shower.

This enables the shower head assembly 10 to generate and discharge "clusters" of thin water jets for purposes of modulating a force of an outflow of water such that the water flow provides a relatively "soft" feeling for uses and undesired splashing of water can be reduced. This helps to save water due to improved operating efficiency of the shower head assembly 10 and allows the shower head assembly 10 to function normally even in a low pressure environment.

Preferably, in one example, the diameter of each jet orifice 241 is between 0.5 mm and 0.7 mm. In another example, the diameter of each jet orifice 241 is between 0.2-0.5 mm. The diameter of the jet orifices 241 can also have any other suitable ranges, for example in a range of 0.2 mm-0.3 mmc or 0.3 mm-0.5 mm. The distance between the two jet orifices 241 in a particular water outlet unit 24 is more than 1 mm.

The face panel 2 is directly formed, or it may be made of a plastic material by injection molding or a rubber material by molding, or assembled by molding. In one example, the at least one water outlet unit 24 is formed of rubber materials by molding and then the face panel 2 is formed by overmolding the plastic materials onto the formed at least one water outlet unit 24. In another example, the face panel 2 and the at least one water outlet unit 24 are assembled together, wherein the at least one water outlet unit 24 is formed as one piece or more pieces with rubber materials by molding and the face plate 2 is formed by plastic materials or metal materials by molding.

Referring to the Figures, the main body 1 comprises a housing 5 and a water diversion body 6. The upper end of the housing 5 has an opening 51 and an inner flange 52 adjacent the opening 51. The lower end of the housing 5 has a connecting opening 53. The face plate 2 is removably connected to the connecting opening 53 by a fastener, such as a threaded fastener. In the illustrative embodiment, external threads on the face plate 2 engage with internal threads of the housing 5 for connecting the face plate 2 with the housing 5. The side wall of the housing 5 has an installation hole 54 for installation of the switching device 4. The upper portion of the water diversion body 6 has a water inlet passage 61. The middle portion of the water diversion body 6 has an accommodation chamber 62 for installation of the switching device 4 and at least two water outlets to respectively communicate with the first outlet chamber 22 and the second outlet chamber 23 of the face panel 2.

The switching device 4 is a push-type changeover valve which is installed to the accommodation chamber 62 of the water diversion body 6. Referring to FIGS. 2 and 3, the switching device 4 includes a button having a cover 41*a* and a selector 41*b*, a valve body 42, a valve shaft 43, a return spring 44, a limit ring 45, and a gasket 46. The button (41*a*, 41*b*) is fitted on the top end of the valve shaft 43. The valve shaft 43 is orderly inserted through the valve body 42, the limit ring 45 and the gasket 46, and connected to the return spring 44. A sealing ring (e) and a sealing ring (f) are provided between the valve body 42 and the accommodation chamber 62 so as to ensure the water-proof and sealing function during operation of the shower head assembly 10. A V-shaped ring 47 is provided between the valve body 42 and the valve shaft 43. To facilitate the use of the button (41*a*, 41*b*), the outer wall of the water diversion body 6 may be provided with a protruding post 63 which is rotatably connected with the button (41*a*, 41*b*).

When the user actuates the button (41*a*, 41*b*), such as depressing the button (41*a*, 41*b*), the gasket 46 on the valve shaft 43 is moved to the set position to close one of the water outlets. For example, the gasket 46 closes one of the water outlets so that the water inlet passage 61 communicates with the second outlet chamber 23, or the gasket 46 closes the other water outlet so that the water inlet passage 61 communicates with the first outlet chamber 22.

To assemble the present invention, all the parts of the switching device 4 except the button (41*a*, 41*b*) are installed in the water diversion body 6, and the water diversion body 6 is installed in the housing 5. The button (41*a*, 41*b*) is installed on the valve shaft 43 and the protruding post 63 through the installation hole 54. The upper end of the water diversion body 6 is against the flange 52 of the housing 5. The face panel 2 is affixed to the connecting opening 53 of the housing 5, and the face panel 2 is fitted to the lower end of the water diversion body 6 through sealing rings (b) and (c), so that the face panel 2 is stably secured in the housing 5. Finally, the bubbler 3 is removably affixed to the face panel 2.

The casing 5 and the water diversion body 6 may be integrally formed, not limited to the above-described separate structures to be assembled together. The switching device 4 is not limited to the push-type switching valve, and may be a rotary-type switching valve or a slide-type switching valve.

Figure 9:
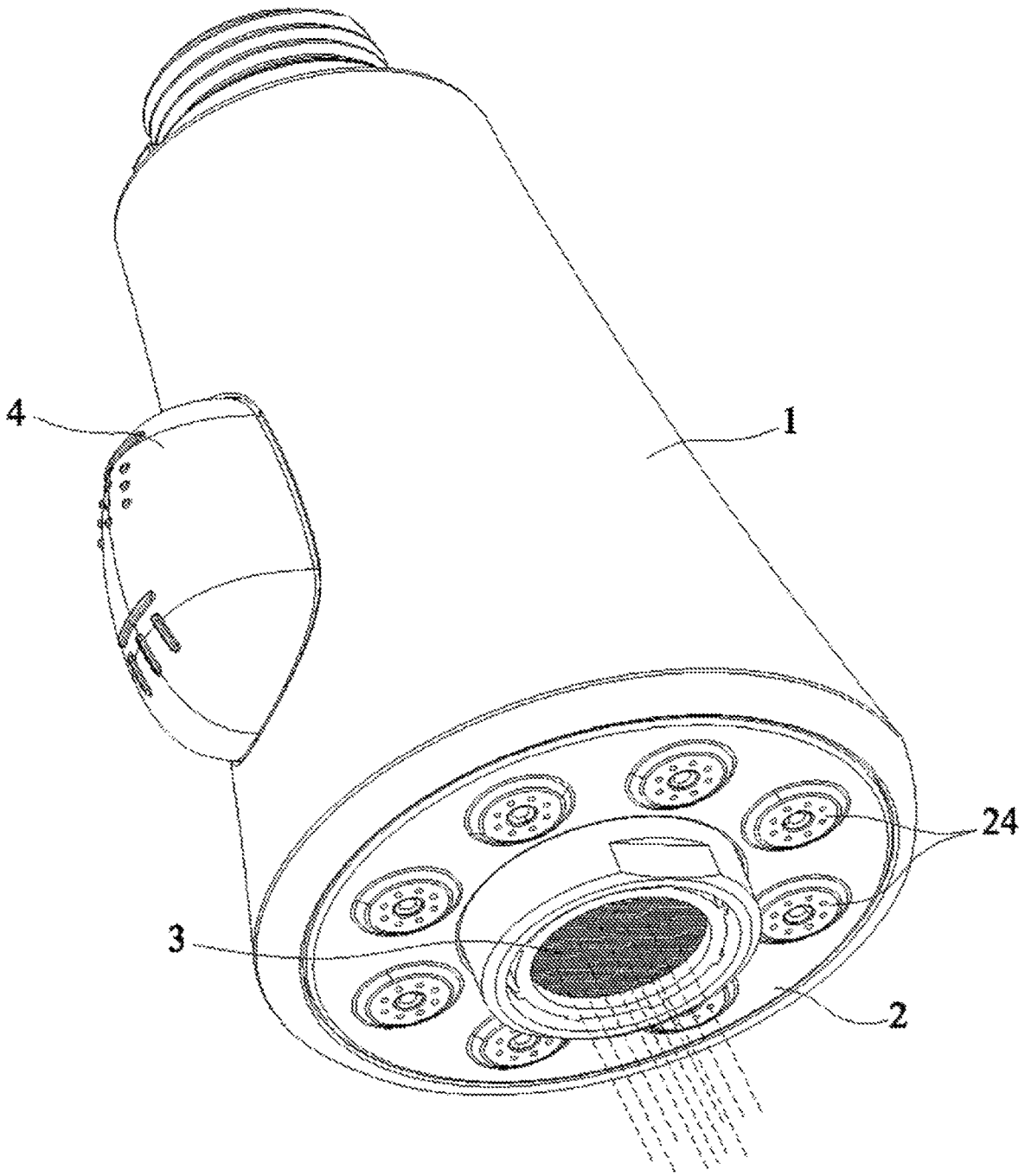
FIG. 9 is a perspective view of the shower head assembly during use where the discharge water flows from a bubbler of the shower head assembly.

To practice the present invention in a first operating mode of the spray head assembly 10, referring to FIG. 9, water flows from the water inlet passage 61 into the accommodation chamber 62. When the user actuates the switching device 4, the water can flow out only from the bubbler 3 through the first outlet chamber 22. The discharge water flow is aerated with bubbles so that the discharged water feels soft and comfortable to the user, without random spray that reduces the water-saving effect of the shower head assembly 10.

Figure 10:
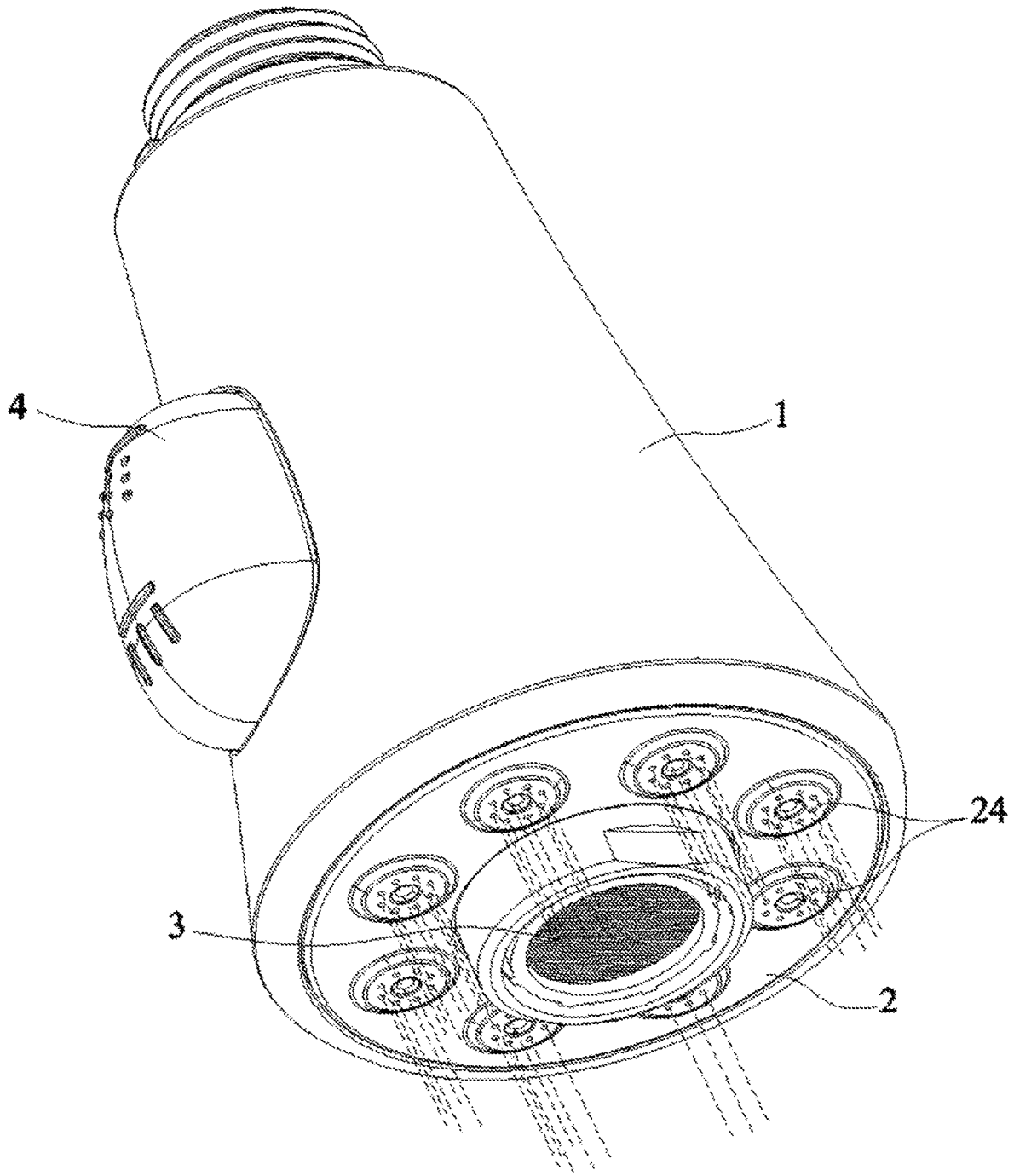
FIG. 10 is a perspective view of the shower head assembly during use where the discharge water flows from a plurality of water outlet units.

In a second operating mode of the spray head assembly 10, shown in FIG. 10, the water flows from the water inlet passage 61 into the accommodation chamber 62. By actuating the switching device 4, the water can be ejected only from the water outlet unit 24 through the second outlet chamber 23. The bunched water discharged from each water outlet unit 24 includes a plurality of fine spouts through the jet orifices 241 that avoids random spray. Since the diameter of the jet orifice 241 is small, the force of the fine spouts is stronger, which improves the feel of the discharged water while maintaining the water-saving effect of the shower head assembly 10.

Although particular embodiments of the present invention have been described in detail for purposes of illustration, various modifications and enhancements may be made without departing from the spirit and scope of the present invention. Accordingly, the present invention is not to be limited except as by the following claims.

What is claimed is:

1. A shower head assembly comprising:

a main body adapted to be coupled to a water source;

a face plate coupled to the main body, the face plate having a central water outlet and a plurality of water outlet units arranged around the central water outlet in a first pattern, each water outlet unit having a plurality of jet orifices spaced from each other by a predetermined distance and arranged in a second pattern forming a circle about a center point within each water outlet unit; and a switching device coupled to the main body and configured to direct a flow of water, at the selection of a user, from the water source to either (i) the central water outlet for discharge, or (ii) the plurality of water outlet units for discharge through the jet orifices.

2. The shower head assembly of claim 1, wherein the predetermined distance between the jet orifices is more than 1 mm.

3. The shower head assembly of claim 1, wherein the jet orifices each have a diameter of 0.2 mm-0.7 mm.

4. The shower head assembly of claim 1, wherein the jet orifices each have a diameter of 0.2 mm-0.3 mm.

5. The shower head assembly of claim 1, further comprising a bubbler coupled to the central water outlet of the face plate.

6. The shower head assembly of claim 1, wherein the main body includes a housing and a water diversion body, and wherein the water diversion body is coupled to the water source and the water diversion body extends through the housing.

7. The shower head assembly of claim 6, wherein the housing is integrally formed with the water diversion body.

8. The shower head assembly of claim 1, wherein the plurality of water outlet units are formed of rubber materials by molding and then the face plate is formed by overmolding of plastic materials around the plurality of water outlet units.

9. The shower head assembly of claim 1, wherein the plurality of water outlet units are formed separate from the face plate and then assembled with the face plate.

10. The shower head assembly of claim 1, wherein the face plate defines both a first outlet chamber in fluid communication with the central water outlet and a second outlet chamber in fluid communication with the plurality of water outlet units, and wherein the switching device is configured to direct the flow of water from the water source to first outlet chamber or the second outlet chamber at the selection of a user.

11. The shower head assembly of claim 1, wherein the plurality of jet orifices in each water outlet unit includes at least four jet orifices.

12. A shower head assembly comprising:

a housing with a water diversion body adapted to be coupled to a water source; and a face plate coupled to the housing, the face plate having a plurality of discrete water outlet units annularly arranged around a central water outlet formed in the face plate, and each water outlet unit having a plurality of jet orifices (i) spaced from each other by a predetermined distance and (ii) arranged in a pattern about a center point within each water outlet unit;

wherein the jet orifices of the plurality of water outlet units are arranged to discharge water through the jet orifices at the same time to provide a strong, fine spray of discharged water.

13. The shower head assembly of claim 12, wherein the predetermined distance between the jet orifices is more than 1 mm.

14. The shower head assembly of claim 12, wherein the jet orifices each have a diameter of 0.2 mm-0.7 mm.

15. The shower head assembly of claim 12, wherein the jet orifices each have a diameter of 0.2 mm-0.3 mm.

16. The shower head assembly of claim 12, wherein the plurality of water outlet units are formed of rubber materials by molding and then the face plate is formed by overmolding of plastic materials around the plurality of water outlet units.

17. The shower head assembly of claim 12, wherein the plurality of water outlet units are formed separate from the face plate and then assembled with the face plate.

18. The shower head assembly of claim 12, wherein the jet orifices of each water outlet unit are arranged in a circular, oval, pentagonal, or triangular shaped pattern.

19. The shower head assembly of claim 12, wherein each of the water outlet units is defined by a border, and wherein the plurality of jet orifices are located within the border.

20. The shower head assembly of claim 19, wherein the border is raised such that the water outlet unit is raised relative to the face plate.

21. The shower head assembly of claim 12, wherein the plurality of jet orifices in each water outlet unit includes at least four jet orifices.

* * * * *